US008866110B2

(12) United States Patent
Tao et al.

(10) Patent No.: US 8,866,110 B2
(45) Date of Patent: Oct. 21, 2014

(54) EXTREME ULTRAVIOLET LIGHT SOURCE

(71) Applicant: ASML Netherlands B.V., Veldhoven (NL)

(72) Inventors: Yezheng Tao, San Diego, CA (US); Robert Jay Rafac, Encinitas, CA (US); Igor V. Fomenkov, San Diego, CA (US); Daniel J. W. Brown, San Diego, CA (US)

(73) Assignee: ASML Netherlands B.V., Veldhoven (NL)

( * ) Notice: Subject to any disclaimer, the term of this patent is extended or adjusted under 35 U.S.C. 154(b) by 0 days.

(21) Appl. No.: 14/199,261

(22) Filed: Mar. 6, 2014

(65) Prior Publication Data

US 2014/0264092 A1 Sep. 18, 2014

Related U.S. Application Data

(63) Continuation of application No. 13/843,626, filed on Mar. 15, 2013, now Pat. No. 8,680,495.

(51) Int. Cl.
*H05G 2/00* (2006.01)

(52) U.S. Cl.
CPC ..... *H05G 2/003* (2013.01)
USPC ..... 250/504 R; 250/493.1; 355/67

(58) Field of Classification Search
USPC ..... 250/504 R, 493.1; 355/67
See application file for complete search history.

(56) References Cited

U.S. PATENT DOCUMENTS 7,361,204 B1 4/2008 Richardson
7,491,954 B2 2/2009 Bykanov et al.
7,608,846 B2 * 10/2009 Nakano ..... 250/504 R
7,928,416 B2 4/2011 Fomenkov et al.
7,999,241 B2 * 8/2011 Nagai et al. ..... 250/504 R
8,017,924 B2 9/2011 Bykanov et al.
8,164,076 B2 4/2012 Endo
8,242,472 B2 * 8/2012 Moriya et al. ..... 250/504 R (Continued)

FOREIGN PATENT DOCUMENTS

EP 2538759 A1 12/2012
WO WO2013029906 A1 3/2013

OTHER PUBLICATIONS

International Search Report and Written Opinion of the International Searching Authority, received in corresponding International Application No. PCT/US2014/018422, mailed Jun. 9, 2014, 9 pages.

*Primary Examiner* — David A Vanore
(74) *Attorney, Agent, or Firm* — DiBerardino McGovern IP Group LLC

(57) ABSTRACT

Techniques are described that enhance power from an extreme ultraviolet light source with feedback from a target material that has been modified prior to entering a target location into a spatially-extended target distribution or expanded target. The feedback from the spatially-extended target distribution provides a nonresonant optical cavity because the geometry of the path over which feedback occurs, such as the round-trip length and direction, can change in time, or the shape of the spatially-extended target distribution may not provide a smooth enough reflectance. However, it may be possible that the feedback from the spatially-extended target distribution provides a resonant and coherent optical cavity if the geometric and physical constraints noted above are overcome. In any case, the feedback can be generated using spontaneously emitted light that is produced from a non-oscillator gain medium.

20 Claims, 10 Drawing Sheets

(56) References Cited

U.S. PATENT DOCUMENTS

| | | | | |
|---|---|---|---|---|
| 8,304,752 | B2 | 11/2012 | Fomenkov et al. | |
| 8,324,600 | B2 * | 12/2012 | Hayashi et al. | 250/504 R |
| 2010/0176313 | A1 | 7/2010 | Melnychuk | |
| 2011/0057126 | A1 * | 3/2011 | Hoshino et al. | 250/504 R |
| 2012/0228525 | A1 * | 9/2012 | Moriya et al. | 250/504 R |
| 2012/0243566 | A1 | 9/2012 | Hori | |
| 2012/0305810 | A1 | 12/2012 | Ershov | |
| 2012/0305811 | A1 * | 12/2012 | Wakabayashi et al. | 250/504 R |
| 2012/0313016 | A1 * | 12/2012 | Fleurov et al. | 250/504 R |
| 2012/0319014 | A1 * | 12/2012 | Moriya et al. | 250/504 R |
| 2013/0146682 | A1 * | 6/2013 | Ishihara et al. | 239/590 |

* cited by examiner

EXTREME ULTRAVIOLET LIGHT SOURCE

CROSS-REFERENCE TO RELATED APPLICATION

This application is a continuation of U.S. patent application Ser. No. 13/843,626, filed Mar. 15, 2013, now allowed, and titled EXTREME ULTRAVIOLET LIGHT SOURCE, which is incorporated herein by reference in its entirety.

TECHNICAL FIELD

The disclosed subject matter relates to enhancing power from an extreme ultraviolet light source with feedback from a spatially-extended target distribution.

BACKGROUND

Extreme ultraviolet (EUV) light, for example, electromagnetic radiation having wavelengths of around 50 nm or less (also sometimes referred to as soft x-rays), and including light at a wavelength of about 13 nm, can be used in photolithography processes to produce extremely small features in substrates, for example, silicon wafers.

Methods to produce EUV light include, but are not necessarily limited to, converting a material that has an element, for example, xenon, lithium, or tin, with an emission line in the EUV range into a plasma state. In one such method, often termed laser produced plasma (LPP), the plasma can be produced by irradiating a target material, for example, in the form of a droplet, stream, or cluster of material, with an amplified light beam that can be referred to as a drive laser. For this process, the plasma is typically produced in a sealed vessel, for example, a vacuum chamber, and monitored using various types of metrology equipment.

SUMMARY

In some general aspects, a method includes releasing a stream of target material droplets toward a target region, the droplets in the stream traveling along a trajectory from a target material supply system to the target region; producing a spatially-extended target distribution by directing a first pulse of light along a direction of propagation toward the first target material droplet while the first droplet is between the target material supply apparatus and the target region, the impact of the first pulse of light on the first target material droplet increasing a cross-sectional diameter of the first target material droplet in a plane that faces the direction of propagation and decreasing a thickness of the first target material droplet along a direction that is parallel to the direction of propagation; positioning an optic to establish a beam path that intersects the target location; coupling a gain medium to the beam path; and producing an amplified light beam that interacts with the spatially-extended target distribution to produce plasma that generates extreme ultraviolet (EUV) light by scattering photons emitted from the gain medium off of the spatially-extended target distribution, at least some of the scattered photons placed on the beam path to produce the amplified light beam.

Implementations can include one or more of the following features. For example, the EUV light can be generated without providing external photons to the beam path.

The stream can include a plurality of target material droplets, each separated from one another along the trajectory, and separate spatially-extended target distributions are produced from more than one of the droplets in the stream.

The first pulse of light can have a wavelength of 1.06 μm. A cross-sectional diameter of the spatially-extended target distribution in the plane that is transverse to the direction of propagation can be 3 to 4 times larger than the cross-sectional diameter of the first target material droplet.

The spatially-extended target distribution can be produced a time period after the first light pulse impacts the first target material droplet.

The first pulse of light can have a duration of 10 ns. The amplified light beam can have a foot-to-foot duration of 400-500 ns.

The amplified light beam can have wavelength of 10.6 μm. The amplified light beam can have a wavelength that is about ten times the wavelength of the first pulse of light.

The method can include sensing that a first target material droplet in the stream of droplets is between the target material supply system and the target region.

The spatially-extended target distribution can be in the form of a disk. The disk can include a disk of molten metal.

The amplified light beam can interact with the spatially-extended target distribution to generate extreme ultraviolet (EUV) light without any coherent radiation being produced.

The optic can be positioned at a side of the gain medium opposite to the target location to reflect light back on the beam path.

In other general aspects, an extreme ultraviolet light source includes an optic positioned to provide light to a beam path; a target supply system that generates a stream of target material droplets along a trajectory from the target supply system to a target location that intersects the beam path; a light source positioned to irradiate a target material droplet in the stream of target material droplets at a location that is between the target supply system and the target location, the light source emitting light of an energy sufficient to physically deform a target material droplet into a spatially-extended target distribution; a gain medium positioned on the beam path between the target location and the optic; and a spatially-extended target distribution positionable to at least partially coincide with the target location to define an optical cavity along the beam path and between the spatially-extended target distribution and the optic. The spatially-extended target distribution and the target material droplets comprise a material that emits EUV light in a plasma state.

Implementations can include one or more of the following features. For example, the target material can include tin, and the target material droplets can include droplets of molten tin.

The spatially-extended target distribution can have a cross-sectional diameter in a plane that is perpendicular to direction of propagation of an amplified light beam that is produced by the optical cavity, and the cross-sectional diameter of the spatially-extended target distribution can be 3-4 times larger than a cross-sectional diameter of the target material droplet.

Implementations of any of the techniques described above may include a method, a process, a target, an assembly or device for generating optical feedback from a spatially-extended target distribution, a kit or pre-assembled system for retrofitting an existing EUV light source, or an apparatus. The details of one or more implementations are set forth in the accompanying drawings and the description below. Other features will be apparent from the description and drawings, and from the claims.

DRAWING DESCRIPTION

DESCRIPTION

Figure 1:
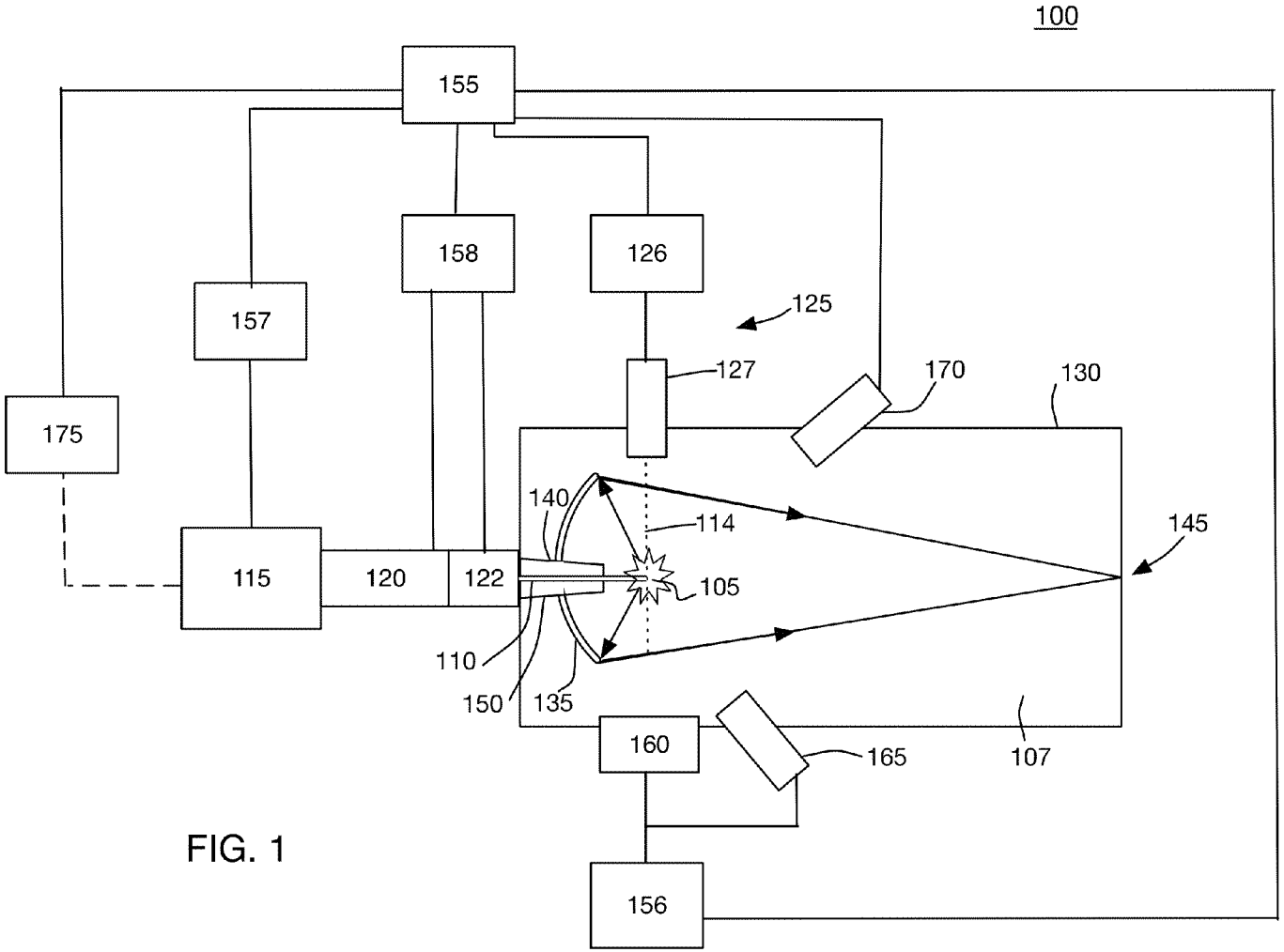
FIG. 1 is a block diagram of an exemplary laser produced plasma extreme ultraviolet light source.

Techniques are described that enhance power from an extreme ultraviolet light source with feedback from a target material that has been modified prior to entering a target location into a spatially-extended target distribution or extended target. The feedback from the spatially-extended target distribution provides a nonresonant optical cavity because the geometry of the path over which feedback occurs, such as the round-trip length and direction, can change in time, or the shape of the spatially-extended target distribution may not provide a smooth enough reflectance. However, it may be possible that the feedback from the spatially-extended target distribution provides a resonant and coherent optical cavity if the geometric and physical constraints noted above are overcome. In any case, the feedback can be generated using spontaneously emitted light that is produced from a non-oscillator gain medium.

In particular, the shape of a droplet of a target material is modified as it travels toward a target location with a pre-pulse optical beam so that the reflectivity of the modified target material when it reaches the target location is much greater than the reflectivity of the target material droplet. In this way, it is possible to provide feedback in a beam path that includes a gain medium by irradiating the highly-reflective spatially-extended target distribution with the light produced from the optical gain medium if a reflecting optic is positioned to reflect light on a beam path that intersects the target location so that the modified target material and the optic form an oscillating optical cavity.

The oscillating optical cavity produced by the reflection off of the spatially-extended target distribution can be considered a random laser with incoherent feedback if the light that reflects from the spatially-extended target distribution provides a scattering surface that reflects light along distinct paths so that the reflected light may not return to its original position (for example, at the reflecting optic) after one round trip. The spatial resonances for the electromagnetic field may be absent in such a cavity and thus, the feedback in such a laser is used to return part of the energy or photons to the gain medium. In this scenario, many modes in the optical cavity interact with the gain medium as a whole, and the statistical properties of the laser emission in this case can be approximated or close to those of the emission of an extremely bright black body in a narrow range of a spectrum. Also, there may be no spatial coherence.

The target material droplets are a part of a stream of target material that is released toward the target location. The target location is on the axis of the beam path and the optical gain medium. Prior to reaching the target location, the pre-pulse optical beam irradiates the target material droplet to form the spatially-extended target distribution, which is a modified shape of the target material such as a flattened or disk-shaped target. The modified shape of the target material can be a mist, cloud of fragments, or a hemisphere-like target that can have similar properties to a disk-shaped target. In any case, the modified shape of the target material has a larger extent or a larger surface area that faces the amplified light beam in the target location. Compared to the original target material droplet, the spatially-extended target distribution has a larger diameter and has a greater reflectivity. The spatially-extended target distribution arrives at the target location, which aligns with the beam path, and begins to generate feedback in the gain medium.

The oscillating optical cavity can be considered a laser with some coherent feedback if the light that reflects from the spatially-extended target distribution provides a non-scattering surface that reflects light along the beam path so that some of the reflected light returns to its original position (for example, at the reflecting optic) after each round trip. The spatial resonances for the electromagnetic field may be present in such a cavity and thus, the feedback in such a laser is used to return more of the energy or photons to the gain medium.

The spatially-extended target distribution can be used in a laser produced plasma (LPP) extreme ultraviolet (EUV) light source. The spatially-extended target distribution includes a target material that emits EUV light when in a plasma state. The target material can be a target mixture that includes a target substance and impurities such as non-target particles. The target substance is the substance that is converted to a plasma state that has an emission line in the EUV range. The target substance can be, for example, a droplet of liquid or molten metal, a portion of a liquid stream, solid particles or clusters, solid particles contained within liquid droplets, a foam of target material, or solid particles contained within a portion of a liquid stream. The target substance, can be, for example, water, tin, lithium, xenon, or any material that, when converted to a plasma state, has an emission line in the EUV range. For example, the target substance can be the element tin, which can be used as pure tin (Sn); as a tin compound, for example, $SnBr_4$, $SnBr_2$, $SnH_4$; as a tin alloy, for example, tin-gallium alloys, tin-indium alloys, tin-indium-gallium alloys, or any combination of these alloys. Moreover, in the situation in which there are no impurities, the target material includes only the target substance. The discussion below provides examples in which the target material is a target material droplet made of molten metal. In these examples, the target material is referred to as the target material droplet. However, the target material can take other forms.

With reference to FIG. 1, a general description of an exemplary laser produced plasma (LPP) extreme ultraviolet (EUV) light source 100 in which the techniques are implemented is initially provided as background.

The LPP EUV light source 100 is formed by irradiating a target mixture 114 at a target location 105 with the amplified light beam 110 that travels along a beam path toward the target mixture 114. The target location 105, which is also referred to as the irradiation site, is within an interior 107 of a vacuum chamber 130. When the amplified light beam 110 strikes the target mixture 114, a target material within the target mixture 114 is converted into a plasma state that has an element with an emission line in the EUV range. The created plasma has certain characteristics that depend on the composition of the target material within the target mixture 114. These characteristics can include the wavelength of the EUV light produced by the plasma and the type and amount of debris released from the plasma.

The light source 100 also includes a target material delivery system 125 that delivers, controls, and directs the target mixture 114 in the form of liquid droplets, a liquid stream, solid particles or clusters, solid particles contained within liquid droplets or solid particles contained within a liquid stream. The target mixture 114 includes the target material such as, for example, water, tin, lithium, xenon, or any material that, when converted to a plasma state, has an emission line in the EUV range. For example, the element tin can be used as pure tin (Sn); as a tin compound, for example, $SnBr_4$, $SnBr_2$, $SnH_4$; as a tin alloy, for example, tin-gallium alloys, tin-indium alloys, tin-indium-gallium alloys, or any combination of these alloys. The target mixture 114 can also include impurities such as non-target particles. Thus, in the situation in which there are no impurities, the target mixture 114 is made up of only the target material. The target mixture 114 is delivered by the target material delivery system 125 into the interior 107 of the chamber 130 and to the target location 105.

The light source 100 includes a drive laser system 115 that produces the amplified light beam 110 due to a population inversion within the gain medium or mediums of the laser system 115. The light source 100 includes a beam delivery system between the laser system 115 and the target location 105, the beam delivery system including a beam transport system 120 and a focus assembly 122. The beam transport system 120 receives the amplified light beam 110 from the laser system 115, and steers and modifies the amplified light beam 110 as needed and outputs the amplified light beam 110 to the focus assembly 122. The focus assembly 122 receives the amplified light beam 110 and focuses the beam 110 to the target location 105.

In some implementations, the laser system 115 can include one or more optical amplifiers, lasers, and/or lamps for providing one or more main pulses and, in some cases, one or more pre-pulses. Each optical amplifier includes a gain medium capable of optically amplifying the desired wavelength at a high gain, an excitation source, and internal optics. The optical amplifier may or may not have laser mirrors or other feedback devices that form a laser cavity. Thus, the laser system 115 produces an amplified light beam 110 due to the population inversion in the gain media of the laser amplifiers even if there are no permanent feedback devices that form a laser cavity. Moreover, the laser system 115 can produce an amplified light beam 110 that is a coherent laser beam if there is a laser cavity to provide enough feedback to the laser system 115. The term "amplified light beam" encompasses one or more of: light from the laser system 115 that is merely amplified but lacks a permanent optical feedback device and thus, may not necessarily provide coherent laser oscillation, and light from the laser system 115 that is amplified (externally or within a gain medium in the oscillator) and is also a coherent laser oscillation due to a permanent optical feedback device.

The optical amplifiers in the laser system 115 can include as a gain medium a filling gas that includes $CO_2$ and can amplify light at a wavelength of between about 9.1 μm and about 11 μm, and in particular, at about 10.6 μm, at a gain greater than or equal to 1000. In some examples, the optical amplifiers amplify light at a wavelength of 10.59 μm. Suitable amplifiers and lasers for use in the laser system 115 can include a pulsed laser device, for example, a pulsed, gas-discharge $CO_2$ laser device producing radiation at about 9.3 μm or about 10.6 μm, for example, with DC or RF excitation, operating at relatively high power, for example, 10 kW or higher and high pulse repetition rate, for example, 50 kHz or more. The optical amplifiers in the laser system 115 can also include a cooling system such as water that can be used when operating the laser system 115 at higher powers.

Figure 2:
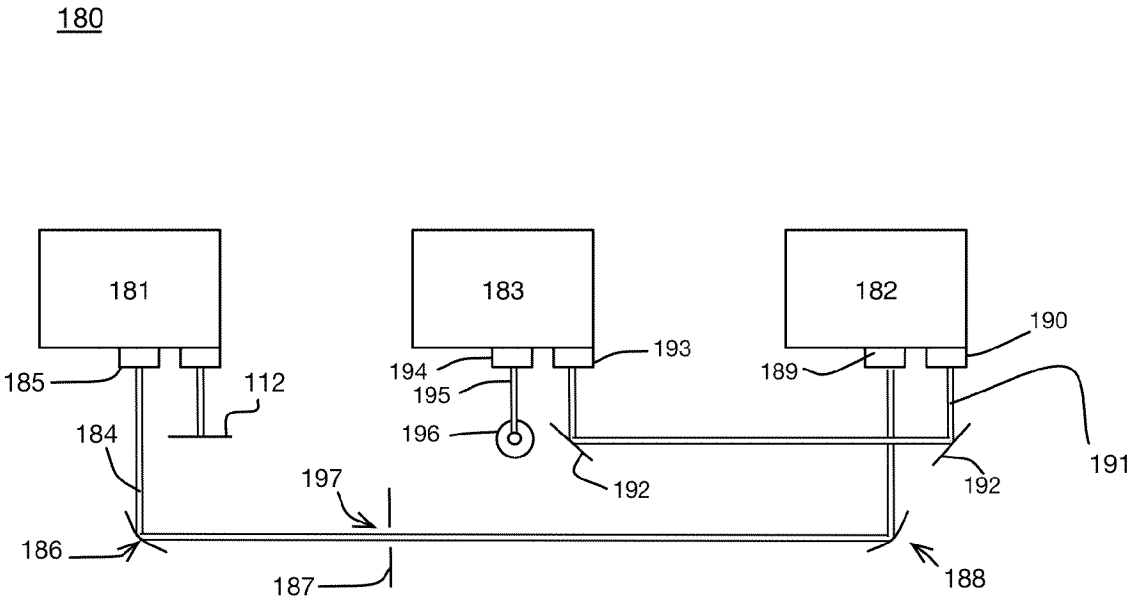
FIG. 2 is a block diagram of an example of a drive laser system that can be used in the light source of FIG. 1.

FIG. 2 shows a block diagram of an example drive laser system 180. The drive laser system 180 can be used as the drive laser system 115 in the source 100. The drive laser system 180 includes three power amplifiers 181, 182, and 183. Any or all of the power amplifiers 181, 182, and 183 can include internal optical elements (not shown). The power amplifiers 181, 182, and 183 each include a gain medium in which amplification occurs when pumped with an external electrical or optical source. For example, each of the power amplifiers 181, 182, 183 includes a pair of electrodes on each side of a gain medium to provide an external electrical source. Additionally, a reflective optic 112 is placed along a beam path defined between the amplifiers 181, 182, 183.

Spontaneously emitted photons from within the gain media of the amplifiers 181, 182, 183 can be scattered by the spatially-extended target distribution (as discussed below) when the spatially-extended target distribution is within the target location, and at least some of these scattered photons are placed on a beam path in which they travel through each of the amplifiers 181, 182, 183. This beam path is described next.

Light 184 travels between the power amplifier 181 and the power amplifier through coupling window 185 of the power amplifier 181 and a coupling window 189 of the amplifier 182 by being reflected off a pair of curved mirrors 186, 186. The light 184 also passes through a spatial filter 187. The light 184 is amplified in the power amplifier 182 and directed out of the power amplifier 182 through another coupling window 190 as light 191. The light 191 travels between the amplifier 183 and the amplifier 182 as it is reflected off fold mirrors 192 and enters and exits the amplifier 183 through a coupling window 193. The amplifier 183 amplifies the light 191 and the light 191 that exits the amplifier 183 toward the beam transport system 120 travels through coupling window 194 as an amplified light beam 195. A fold mirror 196 can be positioned to direct the amplified beam 195 upwards (out of the page) and toward the beam transport system 120.

The spatial filter 187 defines an aperture 197, which can be, for example, a circular opening through which the light 184 passes. The curved mirrors 186 and 188 can be, for example, off-axis parabola mirrors with focal lengths of about 1.7 m and 2.3 m, respectively. The spatial filter 187 can be positioned such that the aperture 197 coincides with a focal point of the drive laser system 180. The example of FIG. 2 shows three power amplifiers. However, more or fewer power amplifiers can be used.

Referring again to FIG. 1, the light source 100 includes a collector mirror 135 having an aperture 140 to allow the amplified light beam 110 to pass through and reach the target location 105. The collector mirror 135 can be, for example, an ellipsoidal mirror that has a primary focus at the target location 105 and a secondary focus at an intermediate location 145 (also called an intermediate focus) where the EUV light can be output from the light source 100 and can be input to, for example, an integrated circuit beam positioning system tool (not shown). The light source 100 can also include an open-ended, hollow conical shroud 150 (for example, a gas cone) that tapers toward the target location 105 from the collector mirror 135 to reduce the amount of plasma-generated debris that enters the focus assembly 122 and/or the beam transport system 120 while allowing the amplified light beam 110 to reach the target location 105. For this purpose, a gas flow can be provided in the shroud that is directed toward the target location 105.

The light source 100 can also include a master controller 155 that is connected to a droplet position detection feedback system 156, a laser control system 157, and a beam control system 158. The light source 100 can include one or more target or droplet imagers 160 that provide an output indicative of the position of a droplet, for example, relative to the target location 105 and provide this output to the droplet position detection feedback system 156, which can, for example, compute a droplet position and trajectory from which a droplet position error can be computed either on a droplet by droplet basis or on average. The droplet position detection feedback system 156 thus provides the droplet position error as an input to the master controller 155. The master controller 155 can therefore provide a laser position, direction, and timing correction signal, for example, to the laser control system 157 that can be used, for example, to control the laser timing circuit and/or to the beam control system 158 to control an amplified light beam position and shaping of the beam transport system 120 to change the location and/or focal power of the beam focal spot within the chamber 130.

The target material delivery system 125 includes a target material delivery control system 126 that is operable in response to a signal from the master controller 155, for example, to modify the release point of the droplets as released by a target material supply apparatus 127 to correct for errors in the droplets arriving at the desired target location 105.

Additionally, the light source 100 can include a light source detector 165 that measures one or more EUV light parameters, including but not limited to, pulse energy, energy distribution as a function of wavelength, energy within a particular band of wavelengths, energy outside of a particular band of wavelengths, and angular distribution of EUV intensity and/or average power. The light source detector 165 generates a feedback signal for use by the master controller 155. The feedback signal can be, for example, indicative of the errors in parameters such as the timing and focus of the laser pulses to properly intercept the droplets in the right place and time for effective and efficient EUV light production.

The light source 100 can also include a guide laser 175 that can be used to align various sections of the light source 100 or to assist in steering the amplified light beam 110 to the target location 105. In connection with the guide laser 175, the light source 100 includes a metrology system 124 that is placed within the focus assembly 122 to sample a portion of light from the guide laser 175 and the amplified light beam 110. In other implementations, the metrology system 124 is placed within the beam transport system 120. The metrology system 124 can include an optical element that samples or re-directs a subset of the light, such optical element being made out of any material that can withstand the powers of the guide laser beam and the amplified light beam 110. A beam analysis system is formed from the metrology system 124 and the master controller 155 since the master controller 155 analyzes the sampled light from the guide laser 175 and uses this information to adjust components within the focus assembly 122 through the beam control system 158.

Thus, in summary, the light source 100 produces the amplified light beam 110 that is directed along the beam path when at least some of the spontaneously emitted photons on the beam path from the laser system 115 are reflected from the spatially-extended target distribution and from the reflecting optic 112 to produce more light at wavelengths within the gain band of the gain medium along the beam path to provide laser action in the laser system 115 (there is enough stimulated emission). In this way, enough energy is imparted to the target material within the spatially-extended target distribution to thereby convert the target material into plasma that emits light in the EUV range. The amplified light beam 110 operates at a particular wavelength (that is also referred to as a source wavelength) that is determined based on the design and properties of the laser system 115. At least some of the amplified light beam 110 is reflected back into the beam path off of the spatially-extended target distribution to provide feedback into the laser system 115.

Figure 3:
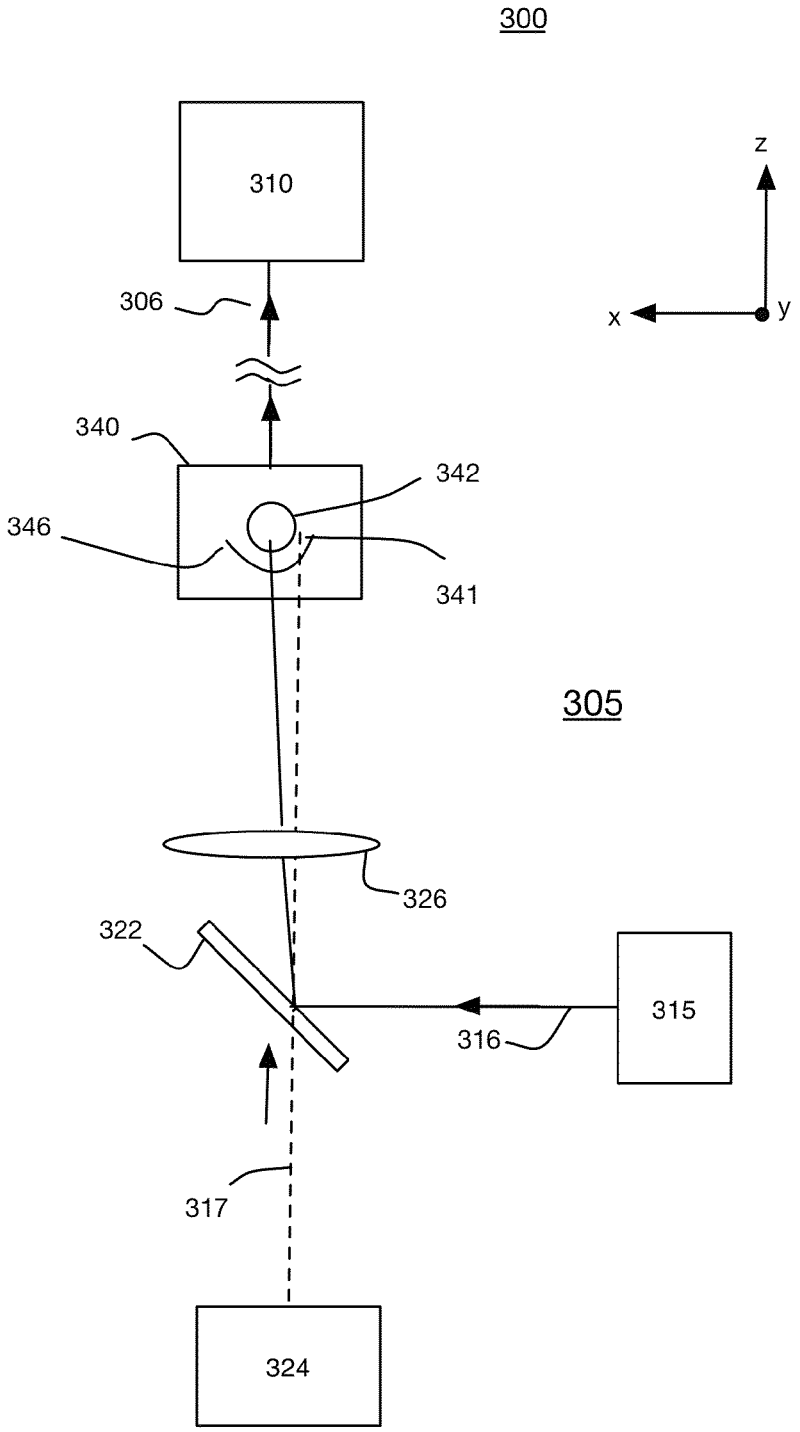
FIG. 3 is a top plan view of a laser produced plasma extreme ultraviolet (EUV) light source and a lithography tool coupled to the EUV light source.

Referring to FIG. 3, a top plan view of an exemplary optical imaging system 300 is shown. The optical imaging system 300 includes an LPP EUV light source 305 that provides EUV light 306 to a lithography tool 310. The light source 305 can be similar to, and/or include some or all of the components of, the light source 100 of FIGS. 2A and 2B.

The light source 305 includes a drive laser system 315, an optical element 322, a pre-pulse source 324, a focusing assembly 326, a vacuum chamber 340, and an EUV collecting optic 346. The EUV collecting optic 346 directs EUV light emitted from a target location 342 to the lithography tool 310. The EUV collection optic 346 can be the collector mirror 135 (FIG. 1), and the target location 342 can be at a focal point of the collection optic 346.

The drive laser system 315 produces an amplified light beam 316. The drive laser system 315 can be, for example, the drive laser system 180 of FIG. 2. The pre-pulse source 324 emits a pulse of radiation 317. The pre-pulse source 324 can be, for example, a Q-switched Nd:YAG laser, and the pulse of radiation 317 can be a pulse from the Nd:YAG laser.

The optical element 322 directs the amplified light beam 316 and the pulse of radiation 317 from the pre-pulse source 324 to the chamber 340. The optical element 322 is any element that can direct the amplified light beam 316 and the pulse of radiation 317 along similar paths and deliver the amplified light beam 316 and the pulse of radiation 317 to the chamber 340.

The amplified light beam 316 is directed to the target location 342 in the chamber 340. The pulse of radiation 317 is directed to a location 341. The location 341 is displaced from the target location 342 in the "−x" direction. In this manner, the pulse of radiation 317 is a "pre-pulse" that can irradiate a target material droplet at a location that is physically distinct from the target location 342 at a time before it reaches the target location 342.

Figure 4:
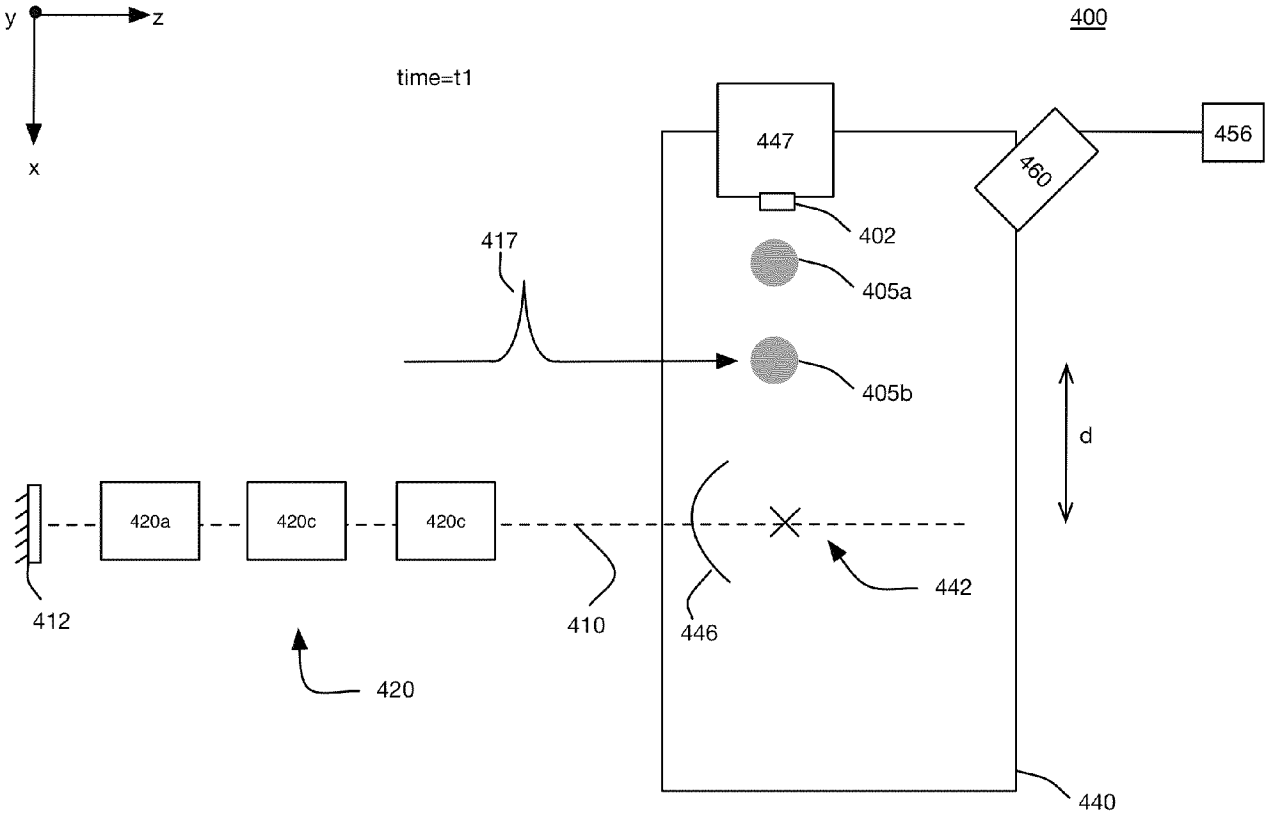
FIGS. 4-7 show side views of another exemplary laser produced plasma extreme ultraviolet light source at four different times.
Figure 5:
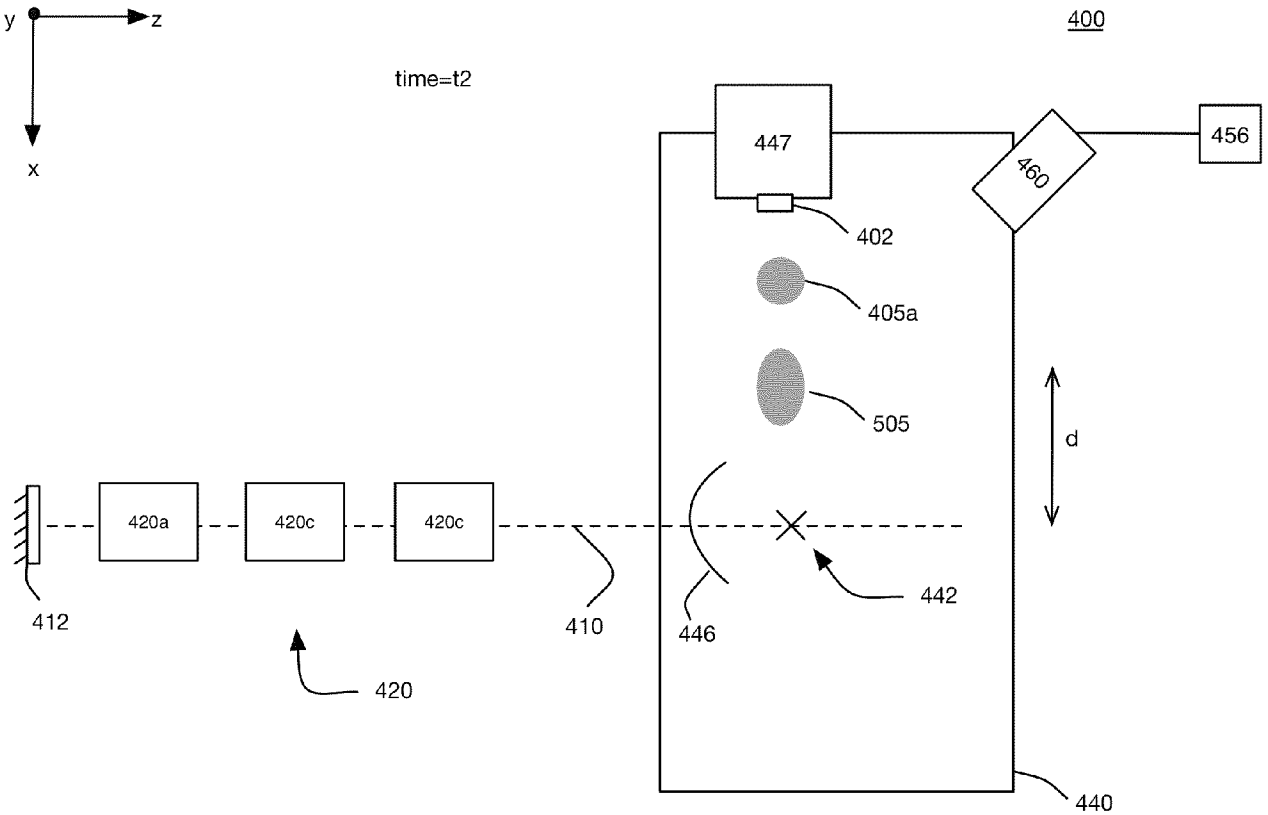
Figure 6:
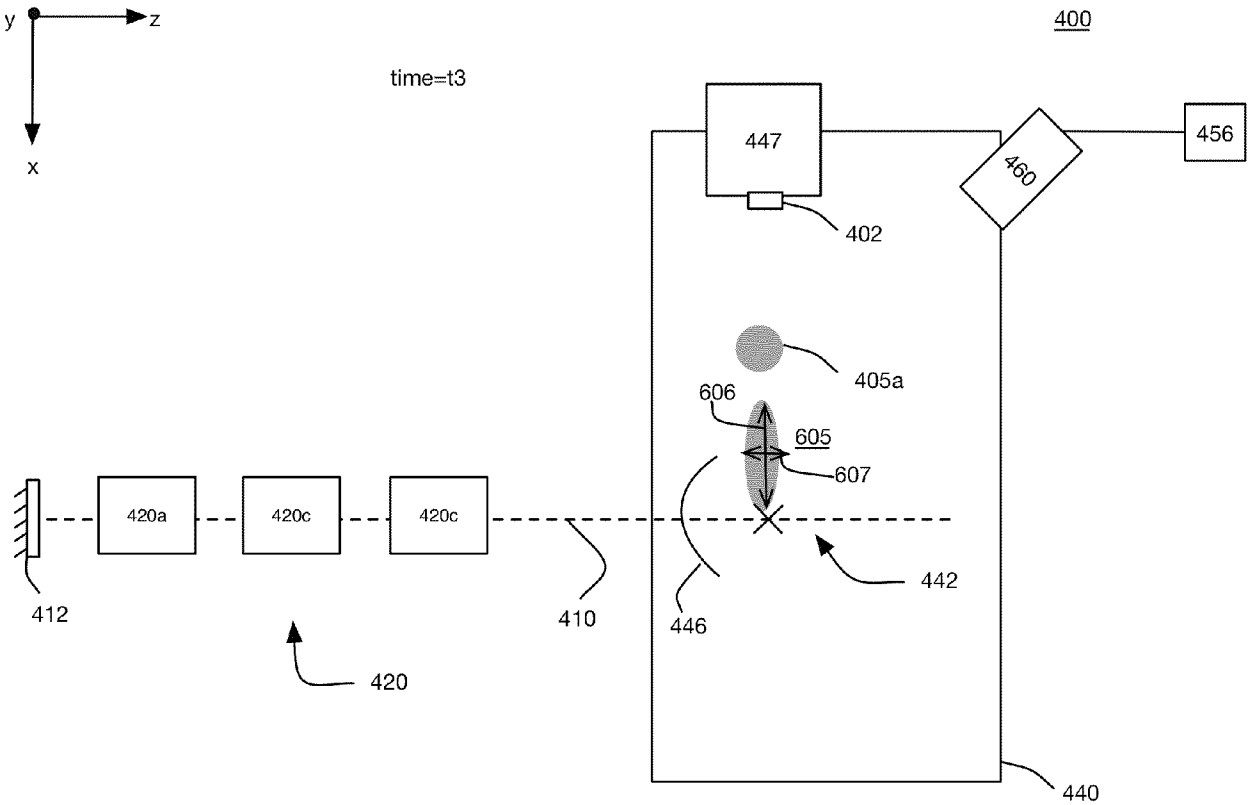
Figure 7:
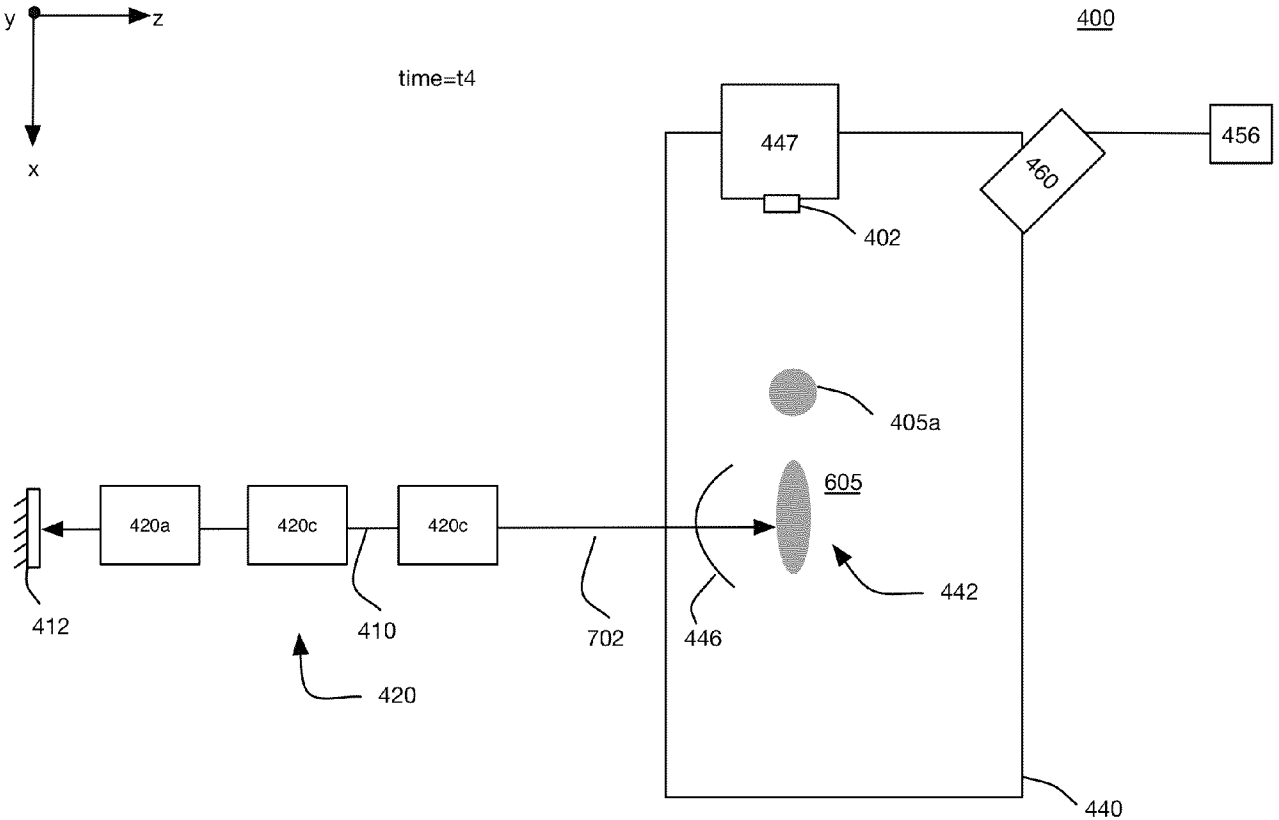

FIG. 4 shows a side view of an exemplary light source 400 that produces EUV light. FIG. 4 shows the light source 400 at a first time, $t=t_1$. FIGS. 5-7 show the light source 400 at later times $t=t_2$, $t=t_3$, and $t=t_4$, with each time being later than the preceding time. FIGS. 4-7 show a target material droplet 405*b* transforming into a spatially-extended target distribution and subsequently providing more photons along the beam path that includes the gain medium to increase gain in the gain band of the gain medium.

As discussed below, the light source 400 produces amplified light at wavelengths within the gain band of the gain medium 420 on a beam path 410 by forming an optical cavity between a reflective optic 412 and a spatially-extended target distribution. To create the spatially-extended target distribution, a target material droplet 405*b* is irradiated with a pulse of radiation 417 while the target material droplet 405*b* is between a target material supply apparatus 447 to a target location 442. When the formed spatially-extended target distribution arrives at the target location 442, the optical cavity (which may be non-resonant) is formed between the optic 412 and the spatially-extended target distribution.

Referring to FIG. 4, the light source 400 includes the optic 412, an optical gain medium 420, a vacuum chamber 440, an EUV collection optic 446, and a target material supply apparatus 447. The light source 400 also can include one or more droplet imagers 460, and a droplet position detection feedback system 456. The target material supply apparatus 447 can be similar to the target material supply apparatus 127 (FIG. 1). The droplet imagers 460 and the droplet position detection feedback system 456 can be similar to the droplet imagers 160 and the droplet position detection feedback system 156 (FIG. 1). The position detection feedback system 456 can include an electronic processor and a tangible computer-readable medium that stores instructions that, when executed, cause the electronic processor to determine a position of a target material droplet based on information from the droplet imagers 460.

At $t=t_1$ (as shown in FIG. 4), the target material supply apparatus 447 has released the target material droplet 405*b* and a target material droplet 405*a*. The droplets 405*a* and 405*b* travel in the "x" direction toward the target location 442. The target location 442 is a location within the chamber 440 that corresponds to a focal point of the EUV collection optic 446. The target location 442 also intersects the beam path 410, which is a path along which the reflective optic 412 directs light. The beam path 410 is defined by the configuration of the optical gain medium 420 and apertures and spatial filters that may be within the arrangement of the optical gain medium 420. The optic 412 can be, for example, a partially or completely reflective mirror.

The source 400 also includes the optical gain medium 420. In the example of FIG. 4, the optical gain medium 400 includes a plurality of optical amplifiers 420*a*, 420*b*, and 420*c*. Each of the optical amplifiers 420*a*, 420*b*, 420*c* includes a pair of electrodes on each side of its respective gain medium to provide an external electrical source. The amplifiers 420*a*, 420*b*, and 420*c* can be similar to the amplifiers 181, 182, and 183 discussed with respect to FIG. 2. The optical gain medium 420 is coupled to and partly defines the beam path 410. That is, light that reflects from the optic 412 enters and can pass through the optical gain medium 420. Spontaneously emitted photons from within the gain media of the amplifiers 420*a*, 420*b*, and 420*c* can exit the gain medium 420 onto and along the beam path 410.

The source 400 also includes the one or more droplet imagers 460, which are connected to a droplet position detection feedback system 456. As the target material droplet 405*b* travels to the target location 442, the imagers 460 measure data that the droplet position detection feedback system 456 uses to determine a position of the target material droplet 405*b* in the "x" direction.

Shortly before the target material droplet 405*b* reaches a location that is a distance "d" from the beam path 410 in the "−x" direction, a pulse of radiation 417 arrives at the location and irradiates the target material droplet 405*b*. The distance "d" is large enough to enable the irradiated target material droplet to adequately change its shape before reaching the target location 442. The distance "d" can be, for example, between about 100 μm and 200 μm, or about 120 μm.

The pulse of radiation 417 can be generated from a source that is similar to the pre-pulse source 324 (FIG. 3A). In some implementations, the pulse of radiation 417 can have a wavelength of 1 micrometer (μm), a pulse duration (measured as full width at half maximum) of 10 nanoseconds (ns), and an energy of 1 mJ (milliJoule). In other implementations, the pulse of radiation 417 can have a wavelength of 1 μm, a pulse duration of 2 ns (when measured using a full width at half maximum or FWHM metric), and an energy of 0.5 mJ. In yet other implementations, the pulse of radiation 417 can have a wavelength of 1 μm, a FMHM pulse duration of 10 ns, and an energy of 0.5 mJ. The pulse of radiation 417 can have a wavelength of 1-10 μm, a FWHM duration of 10-60 ns, and an energy of 10-50 mJ.

Referring to FIG. 5, the source 400 is shown at time $t=t_2$, a time after the pulse of radiation 417 strikes the target material droplet 405*b*. The impact of the pulse of radiation 417 on the target material droplet 405*b* physically deforms the target material droplet 405*b* into a geometric distribution 505 that includes target material. The geometric distribution 505 can be, for example, a region of molten metal with few or no voids. The geometric distribution 505 is elongated in the "x" direction as compared to the target material droplet 405*b*. The geometric distribution 505 also can be thinner along the "z" direction than the target material droplet 405*b*. The geometric distribution 505 continues to expand in the "x" direction as it travels toward the target location 442.

Referring to FIG. 6, at the time $t=t_3$, the geometric distribution 505 has expanded into a spatially-extended target distribution 605 and is at a location just before the beam path 410 in the "−x" direction. The disk shaped target 605 arrives at the beam path axis 410 without being substantially ionized. That is, the spatially-extended target distribution 605 can be considered to be pre-formed before reaching the beam path axis 410.

The spatially-extended target distribution 605 has a longitudinal extent 606 and latitudinal extent 607. The extents 606 and 607 depend on the amount of time elapsed between $t=t_1$ (when the target material droplet 405*b* is struck by the pulse of radiation 417) and $t=t_3$, as well as the pulse duration and energy of the pulse of radiation 417. The extent 606 generally increases as the amount of elapsed time increases. For an elapsed time of 2000 ns, the extent 606 can be about 80-300 μm. In comparison, a similar dimension of the target material droplet 405*a* is about 20-40 μm.

Referring to FIG. 7, at the time $t=t_4$, the target 605 intersects with the beam path 410 and an optical cavity 702 (represented by the solid double arrowed line) is formed between the target 605 and the optic 412. The spontaneously emitted photons on the beam path are reflected from the spatially-extended target distribution 605 and from the reflecting optic 412 to produce more light in the gain band of the gain medium 420 along the beam path 410, and if enough feedback is provided, the losses in the chain are overcome by the buildup from the feedback and all of the energy stored in the gain medium is converted into stimulated emission (to produce the amplified light beam). While the spatially-extended target distribution 602 is in the target location 442 and thus intersects the beam path 410, the amplified light beam irradiates the spatially-extended target distribution 602. In this way, enough energy is imparted to the target material within the spatially-extended target distribution to thereby convert the spatially-extended target distribution 605 into plasma that emits light in the EUV range. And, this is done without using a separate coherent light source to provide the photons to the target location.

Further, because the spatially-extended target distribution 605 has a greater extent 606 than the target material droplet 408*b* from which the spatially-extended target distribution 605 is formed, the spatially-extended target distribution 605 reflects more light back into the optical amplifiers 420, thereby enhancing the light production within the gain band of the optical amplifiers 420. The light produced using the spatially-extended target distribution 605 to form the optical cavity 702 can generate about 2-10 times more light than would be generated with the use an unmodified target material droplet.

Additionally, because the spatially-extended target distribution 605 has a smaller extent 605 in a direction along which the light beam propagates, the spatially-extended target distribution 605 is more easily converted into a plasma that emits EUV light. The relative thinness of the extent 606 means that the spatially-extended target distribution 605 presents more target material to the light beam (the thin shape allows an incident light beam to irradiate more of the target material in the spatially-extended target distribution). Consequently, more of the spatially-extended target distribution is converted to plasma. This results in greater conversion efficiency and less debris. Finally, a smaller initial target material droplet can be used because the technique of using the pulse of radiation 417 to modify the physical shape of the target material droplet 405*b* increases the extent 606. Using a smaller target material droplet can improve the lifetime of the light source 400.

Figure 8:
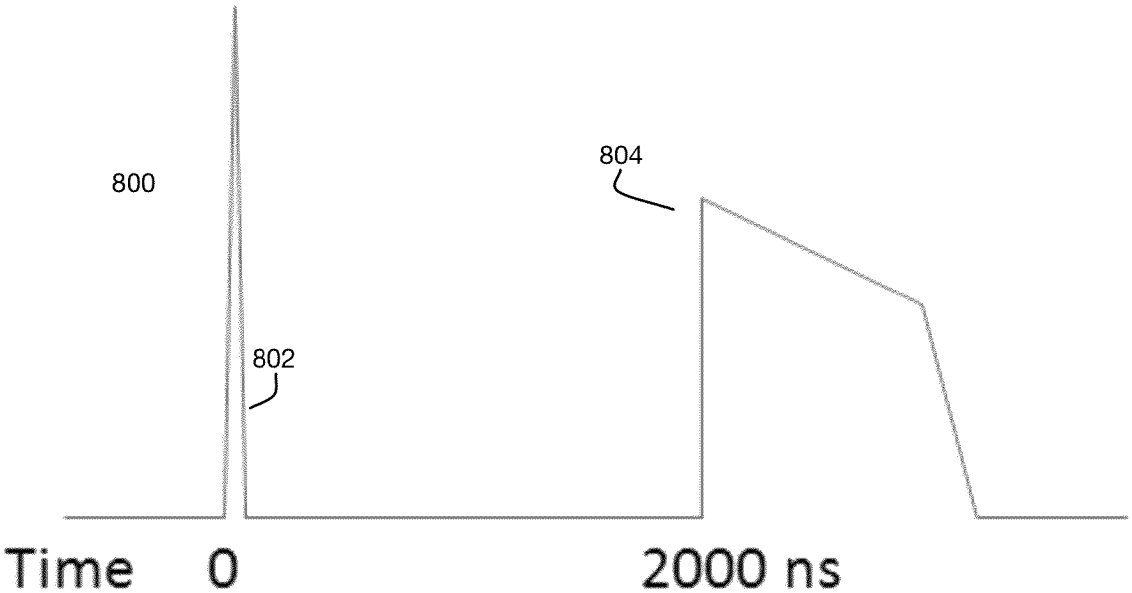
FIG. 8 shows exemplary waveforms of a pre-pulse and a pulse of the amplified light beam.

FIG. 8 shows an example of a pulsed radiation beam 802 used to deform a target material droplet and a light beam 804 that is produced using the deformed target material to form an oscillating optical cavity. The pulsed radiation beam 802 has a wavelength of 1 μm, a pulse duration of 10 ns, and an energy of 1 mJ. The light beam 804 has a duration (measured along a baseline, for example foot-to-foot) of 400-500 ns.

Figure 9:
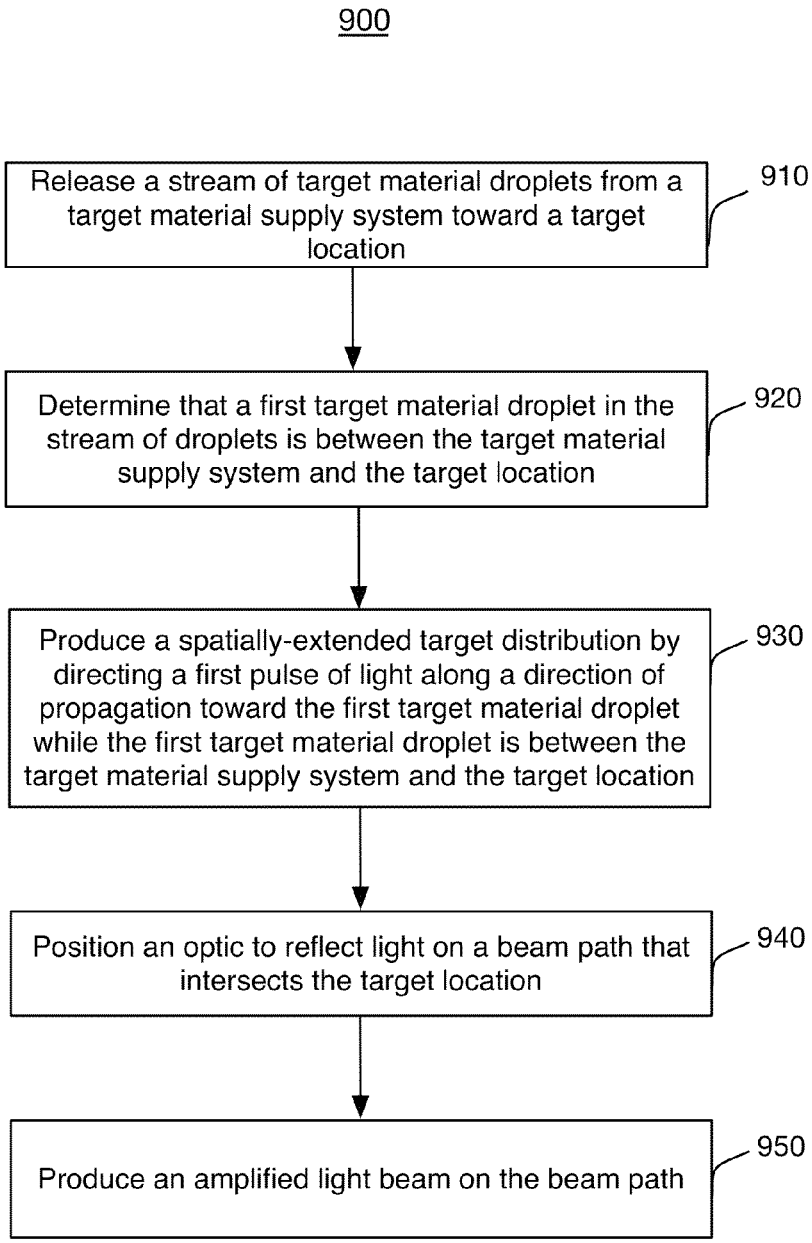
FIG. 9 is a flow chart of an exemplary process for enhancing power in an EUV light source using feedback from a spatially-extended target distribution.

FIG. 9 is a flow chart of an exemplary process 900 for producing an amplified light beam. The process 900 can be performed on any EUV light source that emits a pulsed radiation beam capable of deforming a target material droplet. The example process 900 is discussed with respect to the EUV light source 400.

A stream of target material droplets is released from the target material supply apparatus 447 (910). The stream of target material droplets includes the target material droplets 405*a* and 405*b*. The stream of target material droplets is released or emitted toward the target location 442. The droplet position feedback system 456 may be used to determine that the droplet 405*b* is between the target material supply apparatus 447 and the target location 442 (920). An example of the target material droplet 405*b* being between the target supply apparatus 447 and the target location 442 is shown in FIG. 4. In some implementations, the target material droplet 405*b* is displaced about 120 μm in the "−x" direction when it is determined that the target material droplet 405*b* is between the target supply apparatus 447 and the target location 442.

The spatially-extended target distribution 605 is produced (930). Directing the pulse of radiation 417 toward the target material droplet 405*b* while the droplet 405*b* is between the target supply apparatus 447 and the target location 442, and allowing the resulting physically deformed target material droplet to expand, produces the spatially-extended target distribution 605. As shown in FIG. 5, the interaction between the pulse of radiation 417 and the target material droplet 405*b* deforms the droplet into the geometric distribution 505. A finite period of time passes after the interaction, and the geometric distribution 505 elongates while moving toward the target location 442 and forms the spatially-extended target distribution 605. The pulse of radiation 417 is directed toward the target material droplet 405*b* before it reaches the target location 442. In this manner, the target 605 is pre-formed and not substantially ionized when it reaches the target location 442.

As compared to the target material droplet 405*b*, the spatially-extended target distribution 605 has a greater cross-sectional diameter in a plane that faces an oncoming pulsed radiation beam. A plane that faces the oncoming pulsed radiation beam can be a plane that is transverse to the direction of propagation of the beam. In other examples, the plane can be angled relative to the direction of propagation of the pulsed radiation beam at an angle that is not transverse to the direction of propagation but still allows the spatially-extended target distribution 605 to reflect light back into the amplifier 420. The larger cross-sectional diameter allows the spatially-extended target distribution 605 to reflect more light into the amplifier 420 than the target material droplet 405*b*.

The reflective optic 412 is positioned to reflect some of the light on the beam path 410 (940). The beam path 410 intersects the target location 442. Thus, when the spatially-extended target distribution 605 coincides with the beam path 410 in space, the spatially-extended target distribution 605 and the reflective optic form the optical cavity 702, which may be non-resonant (FIG. 7). An amplified light beam is produced between the spatially-extended target distribution 605 and the reflective optic 412 (950).

The process 900 can be repeated with another target material droplet to improve the gain or amplification of the gain medium 420. The second light beam can be formed 20-40 ns after the first. In this way, a train of light pulses can be generated by repeatedly forming an optical cavity between the reflected optic 412 and spatially-extended target distribution that is formed by irradiating a target material droplet with a pulse of radiation.

Figure 10:
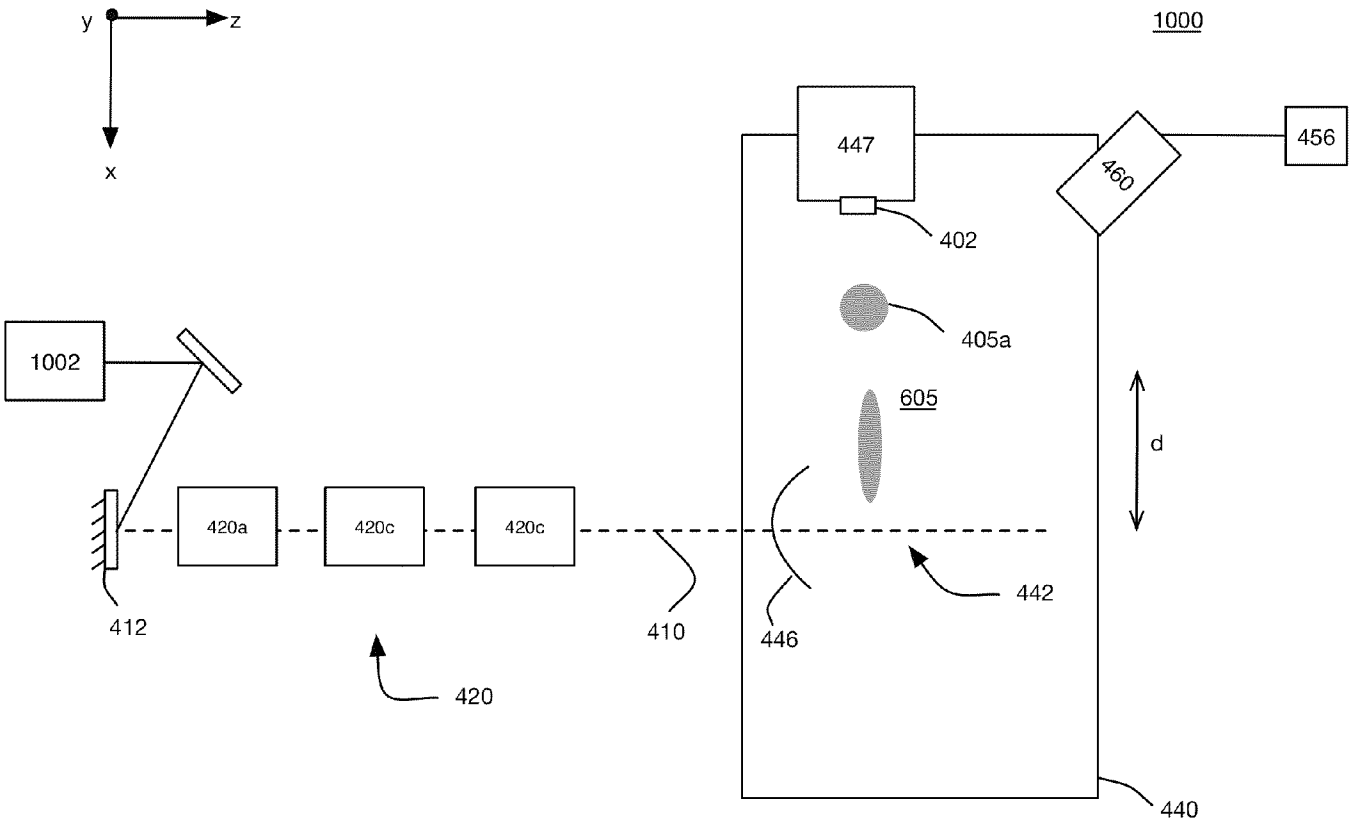
FIG. 10 shows another exemplary laser produced plasma extreme ultraviolet light source.

FIG. 10 shows another exemplary EUV light source 1000. The EUV light source 1000 is similar to the EUV light source 400, and the EUV light source 1000 physically transforms the target material droplet 405*b* into the spatially-extended target distribution 605 by irradiating the target material droplet 405*b* with the pulse of radiation 417. However, the light source 1000 includes an external laser source 1002. The external laser source 1002 supplies photons to the optical path 410 that are within the gain band of the amplifier 420.

There are few ways that light from the source 1002 could be injected, such as at the other end of the chain of gain media 420, for example, through a hole in a turning mirror at the end. This light could reflect off of the spatially-extended target distribution first and then back into the laser.

The EUV light source 1000 is shown at a time just before the spatially-extended target distribution 605 reaches the target location 442. When the spatially-extended target distribution 605 reaches the target location 442, additional photons that are supplied to the optical path 410 (fro reflection off the distribution 605) add to the photons that are emitted by spontaneous emission from within the amplifiers 420*a*, 420*b*, and 420*c*. The photons from the laser source 1002 can be the same wavelength as the gain band of the amplifiers 420*a*, 420*b*, and 420*c*. The presence of additional photons that are amplified by the amplifiers 420*a*, 420*b*, and 420*c* can assist the generation of a light between the spatially-extended target distribution 605 and the reflective optic 412. For example, as compared to a similar EUV light source that lacks the laser source 1002, the light can be generated with less light reflected from the spatially-extended target distribution 605.

Other implementations are within the scope of the claims. For example, the spatially-extended target distribution 605 can have a shape that varies slightly from a disk. The spatially-extended target distribution can have one or more flatted sides and/or an indented surface, for example. The spatially-extended target distribution can have a bowl-like shape.

In the example shown in FIG. 3, the drive laser system 315 and the pre-pulse source 324 are shown as separate sources. However, in other implementations, it is possible that both the pulse of radiation 317 (which can be used as the pulse of radiation 417) and the amplified light beam 316 can be generated by the drive laser system 315. In such an implementation, the drive laser system 315 can include two $CO_2$ seed laser subsystems and one amplifier. One of the seed laser subsystems can produce an amplified light beam having a wavelength of 10.26 μm, and the other seed laser subsystem can produce an amplified light beam having a wavelength of 10.59 μm. These two wavelengths can come from different lines of the $CO_2$ laser. Both amplified light beams from the two seed laser subsystems are amplified in the same power amplifier chain and then angularly dispersed to reach different locations within the chamber 340. In one example, the amplified light beam with the wavelength of 10.26 μm is used as the pre-pulse 317, and the amplified light beam with the wavelength of 10.59 μm is used as the amplified light beam 316. In other examples, other lines of the $CO_2$ laser, which can generate different wavelengths, can be used to generate the two amplified light beams (one of which is the pulse of radiation 317 and the other of which is the amplified light beam 316).

The optical element 322 (FIG. 3) that directs the amplified light beam 316 and the pulse of radiation 317 to the chamber 340 can be any element that can direct the amplified light beam 316 and the pulse of radiation 317 along similar paths. For example, the optical element 322 can be a dichroic beamsplitter that receives the amplified light beam 316 and reflects it toward the chamber 340. The dichroic beamsplitter receives the pulse of radiation 317 and transmits the pulses toward the chamber 340. The dichroic beamsplitter can be made of, for example, diamond.

In other implementations, the optical element 322 is a mirror that defines an aperture. In this implementation, the amplified light beam 316 is reflected from the mirror surface and directed toward the chamber 340, and the pulses of radiation pass through the aperture and propagate toward the chamber 340.

In still other implementations, a wedge-shaped optic (for example, a prism) can be used to separate the main pulse 316, the pre-pulse 317, and the pre-pulse 318 into different angles, according to their wavelengths. The wedge-shaped optic can be used in addition to the optical element 322, or it can be used as the optical element 322. The wedge-shaped optic can be positioned just upstream (in the "−z" direction) of the focusing assembly 326.

Additionally, the pulse of radiation 317 can be delivered to the chamber 340 in other ways. For example, the pulse 317 can travel through optical fibers that deliver the pulses 317 and 318 to the chamber 340 and/or the focusing assembly 326 without the use of the optical element 322 or other directing elements. In these implementations, the fiber can bring the pulse of radiation 317 directly to an interior of the chamber 340 through an opening formed in a wall of the chamber 340.

What is claimed is:

1. A method comprising:

releasing target material from an initial location toward a target region, the target material comprising a material that emits extreme ultraviolet (EUV) light when converted to plasma;

interacting a pulse of light with the target material while the target material is between the initial location and the target region, the interaction producing a spatially extended target distribution having a larger extent in a direction that is different from a direction of propagation of the pulse of light than the target material;

positioning an optic to establish a beam path that intersects the target region;

coupling a gain medium to the beam path, the gain medium spontaneously emitting at least one photon onto the beam path; and interacting photons emitted from the gain medium with the spatially extended target distribution, when the spatially extended target distribution is in the target region, to produce an amplified light beam that converts at least some of the target material in the spatially extended target distribution to plasma that generates EUV light.

2. The method of claim 1, wherein the spatially extended target distribution has a higher reflectivity than the target material.

3. The method of claim 1, wherein the EUV light is generated without providing external photons to the beam path.

4. The method of claim 1, wherein the optic comprises a reflective optic that reflects light to the beam path.

5. The method of claim 1, further comprising determining that the target material is between the initial location and the target region.

6. The method of claim 1, wherein the spatially extended target distribution includes a mist of a material that emits EUV light when converted to plasma.

7. The method of claim 1, wherein the pulse of light comprises light having a wavelength of 1.06 microns (μm).

8. The method of claim 1, wherein the amplified light beam comprises light having a wavelength of 10.6 μm.

9. An extreme ultraviolet light source comprising:

an optic positioned to provide light to a beam path;

a target material supply system configured to provide target material to a target region that intersects the beam path;

a light source configured to irradiate a target material at a location that is between the target region and the target material supply system, the light source configured to produce light having sufficient energy to expand the target material into a spatially extended target distribution;

a gain medium on the beam path between the target region and the optic; and a spatially extended target distribution positionable to at least partially coincide with the target region to define an optical cavity between the optic and the spatially extended target distribution, wherein the target material and the spatially extended target distribution comprise a material that emits extreme ultraviolet (EUV) light in a plasma state.

10. The extreme ultraviolet light source of claim 9, wherein the optic comprises a reflective optic.

11. The extreme ultraviolet light source of claim 9, wherein the spatially extended target distribution comprises a scattering surface that reflects light along a plurality of distinct paths toward the optic.

12. The extreme ultraviolet light source of claim 9, wherein the light source is configured to emit a pulse of light toward the location that is between the target region and the target material supply system.

13. The extreme ultraviolet light source of claim 12, wherein the pulse of light comprises light having a wavelength of 1.06 μm.

14. The extreme ultraviolet light source of claim 9, wherein the spatially extended target distribution has a greater diameter and a greater reflectivity than the target material provided by the target material supply system.

15. The extreme ultraviolet light source of claim 14, wherein the spatially extended target distribution comprises a metal disk, and a diameter of the spatially extended target distribution is greater than a diameter of the target material in a plane that is perpendicular to a direction of light that propagates on the beam path.

16. The extreme ultraviolet light source of claim 15, wherein the target material supply system is configured to provide droplets of molten metal.

17. The extreme ultraviolet light source of claim 9, wherein the optical cavity comprises a non-resonant optical cavity.

18. A method of generating extreme ultraviolet light, the method comprising:

irradiating target material while the target material travels along a target trajectory toward a target region with an amplified light beam to form a target distribution, the target distribution comprising a material that emits extreme ultraviolet (EUV) light when in a plasma state and having a larger spatial extent than the target material;

positioning an optic to form a beam path between the optic and the target region;

coupling a gain medium to the beam path between the optic and the target region;

positioning the target distribution to at least partially coincide with the target region; and interacting photons emitted from the gain medium and propagating on the beam path with the target distribution to produce an amplified light beam that converts at least some of the target material in the target distribution to EUV light.

19. The method of claim 18, wherein positioning the target distribution to at least partially coincide with the target region comprises allowing the target distribution to travel along the target trajectory and into the target region.

20. The method of claim 18, wherein positioning an optic to form a beam path comprises positioning a mirror.

* * * * *